US005491958A

United States Patent [19]

Hammer

[11] Patent Number: 5,491,958

[45] Date of Patent: Feb. 20, 1996

[54] METHOD OF STORING LOGS

[75] Inventor: John F. Hammer, Lilburn, Ga.

[73] Assignee: Cornelia Textiles, Inc., Cornelia, Ga.

[21] Appl. No.: 274,298

[22] Filed: Jun. 30, 1994

[51] Int. Cl.[6] ..... B65B 53/02

[52] U.S. Cl. ..... 53/442; 53/449; 53/447; 150/154

[58] Field of Search ..... 53/442, 449, 447; 206/204; 150/154

[56] References Cited

U.S. PATENT DOCUMENTS

| | | | |
|---|---|---|---|
| 2,156,357 | 5/1939 | Simpson | 206/204 |
| 2,584,241 | 2/1952 | Stewart | 206/451 |
| 3,809,223 | 5/1974 | Kendall | 53/442 |
| 3,945,493 | 3/1976 | Cardinal | 53/442 |
| 4,122,637 | 10/1978 | Runge et al. | 150/154 |
| 4,221,085 | 9/1980 | Conaghan | 150/154 |
| 4,244,411 | 1/1981 | Karlstrom et al. | 150/154 |
| 4,248,343 | 2/1981 | Schaefer | 150/154 |
| 4,597,189 | 1/1986 | Cutrara | 53/442 |

*Primary Examiner*—W. Donald Bray
*Attorney, Agent, or Firm*—Kennedy & Kennedy

[57] ABSTRACT

A stack of logs (40) is inhibited from staining as it is stored in open air by being sheltered with an air pervious plastic material (16). The plastic material has a material to air density of greater than 70% to restrict sunlight, wind and rain and less than 90% to allow adequate ventilation.

6 Claims, 2 Drawing Sheets

METHOD OF STORING LOGS

TECHNICAL FIELD

This invention relates to methods of inhibiting the staining, checking and splitting of logs during storage.

BACKGROUND OF THE INVENTION

It has been understood that timber is often sawed into lumber soon after being cut. This freshly cut lumber typically has a water content of between 60% and 80% by weight. In order to use this lumber for construction it must usually be dried so as to have a water content of approximately 8% or less. The drying process of lumber requires that it be ventilated to allow interior moisture to migrate to the surface and evaporate. During the drying process lumber is typically stacked outdoors in what are commonly referred to as drying yards and left there over an extended period of time. Drying the lumber in this manner reduces its moisture content to approximately 22%. The lumber is then dried in a kiln until its water content is approximately 8%.

While lumber is being dried outdoors it is exposed to the elements causing it to darken in color and degrade in overall appearance. Direct sunlight and wind increases the dehydration rate of the wood which results in the exterior of the wood drying quickly which causes the outside wood cells to close. The closing of these wood cells seals the wood thus preventing interior moisture from escaping. This in turn creates surface cracks in the lumber which are commonly referred to as checking. To inhibit this some lumber manufacturers have draped burlap over the stacks of lumber. Burlap however retains moisture which promotes the growth of wood staining mold and mildew.

Manufacturers have also stored cut lumber in sheds for drying. These sheds have often been of totally enclosed construction which have proved to be costly in construction, maintenance and in properly controlling ventilation. Lumber has also been stored in open sheds which allow the lumber to be constantly ventilated. However, stacks of lumber located near the periphery of the shed are still exposed to the elements that cause checking such as sunlight, wind, and blowing rain and snow.

Logs are also susceptible to checking, splitting and staining during the period of time when they are stored prior to milling. This staining is caused by fungi growth and oxidation while checking and splitting are caused by the ends of the logs drying too quickly.

Manufacturers of lumber have heretofore attempted to prevent these problems from occurring by frequently spraying cold water on the logs to keep them wet. This process however uses a great deal of water which in turn creates a run off that negatively impacts the environment. Today government regulations are mandating stricter controls over the use of water for this purpose. Some regulations mandate the use of settling ponds where water is used in this manner. The construction of these settling ponds is typically made by sacrificing land previously used for log storage. Obviously, this use of the land is not productive towards the goal of milling and storing lumber. The systems which spray the water on the logs also oftentimes becomes clogged causing a restriction in the flow of water to the logs. Thus, the spraying system must also be frequently monitored.

It thus is seen that a need remains for a method of inhibiting the staining, checking and splitting of logs in an efficient and environmentally sound manner. Accordingly, it is to the provision of such a method that the present invention is primarily directed.

SUMMARY OF THE INVENTION

It has now been discovered that by sheltering logs stored in open air with an air pervious plastic material having a material to air density of between 70% and 90%, significant staining may be prevented. Use of this sheltering material has been found to restrict sunlight and wind sufficiently to inhibit checking while yet allowing sufficient ventilation of the logs to inhibit fungi growth and staining.

BRIEF DESCRIPTION OF THE INVENTION

DETAILED DESCRIPTION

Figure 1:
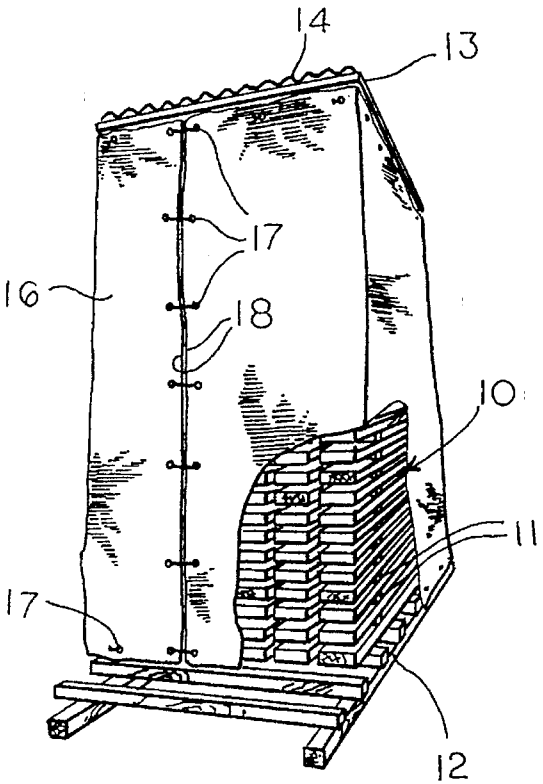
FIG. 1 is a perspective view of a stack of lumber shown draped with an air pervious plastic material in accordance with principles of the invention.

With reference next to the drawings, there is shown in FIG. 1 a freshly cut stack of lumber 10, typically referred to as "green lumber". Green lumber has a water content normally of between 60% and 80%, depending upon the harvest time of the tree from which the lumber is made. The green lumber is stacked with spacers 11 between each layer to allow for ventilation between the individual piece of lumber.

The stack of lumber 10 is mounted upon a pallet 12 and a second pallet 13 is mounted atop the stack. Pallet 13 has a section of corrugated metal roofing 14 mounted thereon to prevent rain water from saturating the lumber. A length of air pervious plastic material 16, having mounting eyelets 17 about its periphery, is mounted to the pallets 12 and 13 wrapped about the sides of the stack. The plastic material 16 may be mounted to the pallets by driving a nail through the eyelets and into the underlying pallet. Adjacent side edges 18 of the material are secured to each other with a rope 19 which extends through the eyelets 17 adjacent the side edges 18.

The air pervious plastic material 16 is preferably made of woven stands of plastic which are UV stable, preferably polypropylene or polyethylene. The plastic is woven to have a material to air density of between 50% and 90%. By this is meant that for a given area of the material between 50% and 90% is plastic and the balance is airspace. It has been found that a material to air density below 50% does not restrict elements such as wind and sunlight sufficient to prevent checking. Additionally, a material density below 50% is often insufficient to restrict blowing rain from passing through the material and onto the lumber. It has also been found that a material to air density above 90% prevents the lumber from drying, at least from drying within a commercially acceptable period of time. The optimal material to air density of material wrapped about a stack of lumber, as just described, has been found to be approximately 80%. With this density wind, rain and sunlight are restricted to a point such that the rate of drying of the lumber is within an acceptable time period and yet significant checking does not occur. In one case a stack of freshly cut white oak was wrapped in woven polypropylene having a material density of 80% for eleven months and was found to have a moisture content of approximately 22% with no discernable checking.

Figure 2:
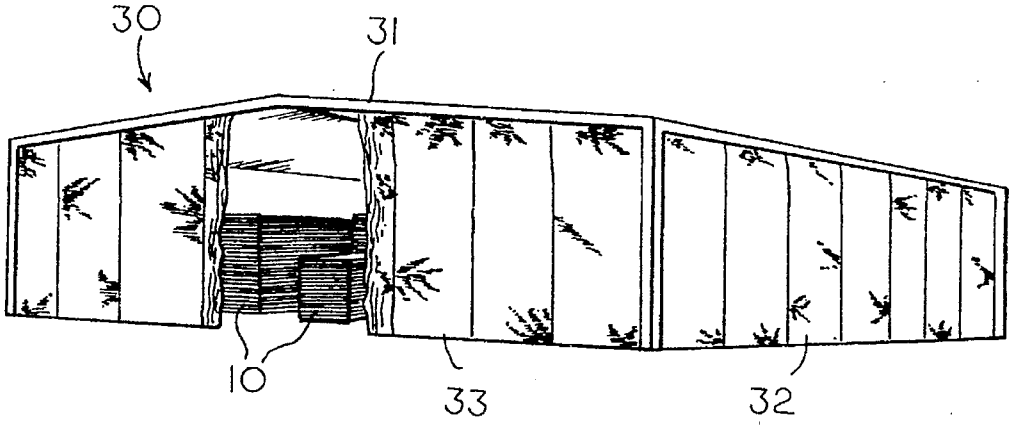
FIG. 2 is a perspective view of lumber placed in a shed and sheltered in accordance with principles of the invention in another preferred form.

Referring next to FIG. 2, there is shown a shed 30 in which stacks of lumber 10 are stored. The shed 30 has open sides 32 and open ends 33 which are draped with air pervious plastic material 16 of the same type as just described. Again, the air pervious plastic material prevents the elements from drying the lumber too quickly. It has been found that the preferred material to air density of the material here, which is spaced from the lumber itself, is approximately 60%. Since the shed itself provides a substantial degree of protection from the elements, the material 16 need not be as restrictive as that wrapped closely about stacks of lumber in drying yards. As many stacks of lumber are typically stacked side by side within these sheds, ventilation is inherently restricted. Thus, the material should allow for more ventilation here then when the material is wrapped about individual stacks of lumber.

Once the lumber has dried in the shed to a water content of approximately 22% it is usually placed in a kiln for further drying. Again, kiln-drying reduces the water content of the lumber to approximately 8%. The lumber is then usually stored prior to shipment in a shed having air pervious plastic material as just described.

Figure 3:
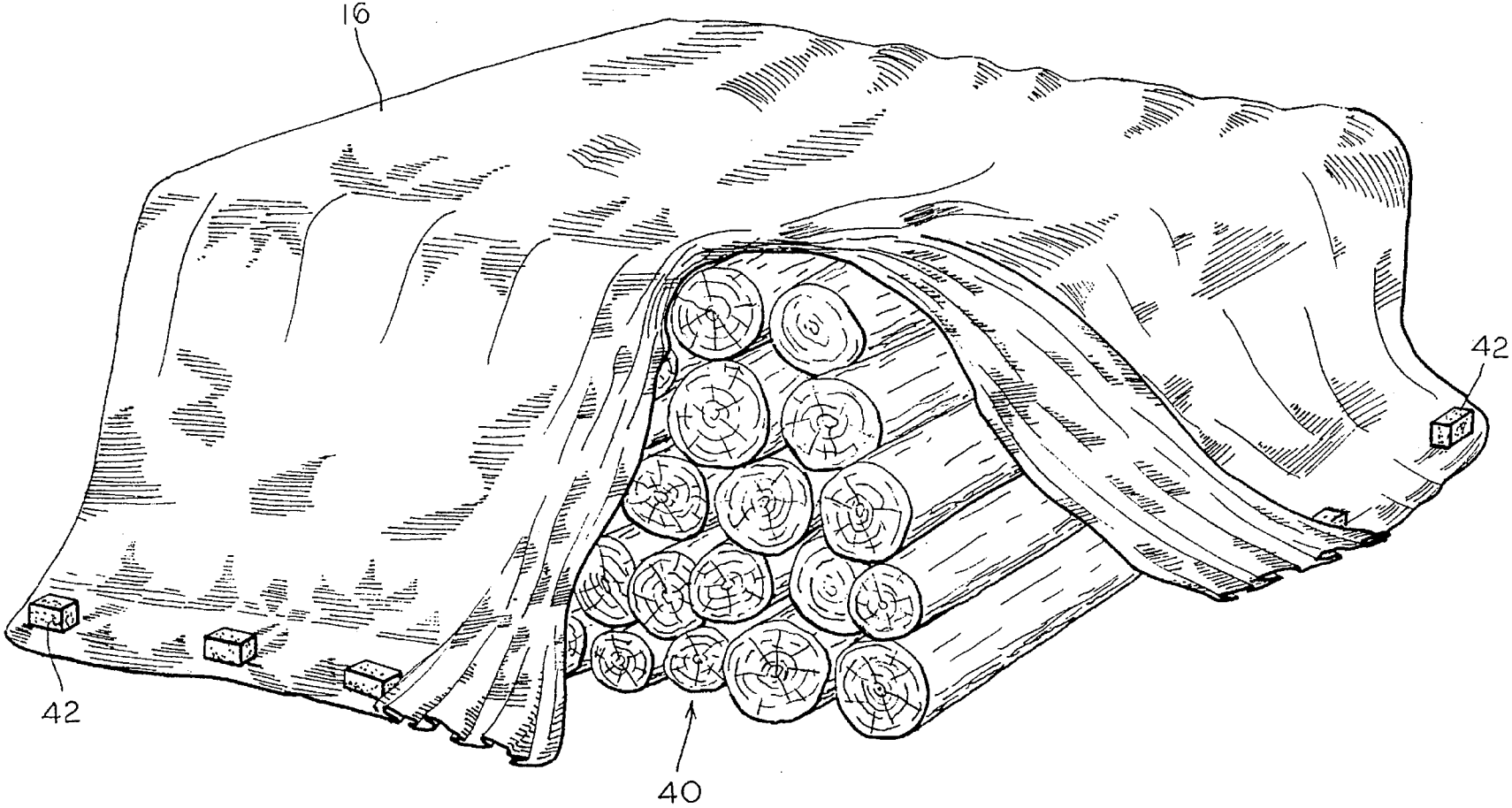
FIG. 3 is a perspective view of a stack of logs shown draped with an air pervious plastic material in accordance with principles of the invention in yet another preferred form of the invention.

Referring next to FIG. 3, there is shown a stack of hardwood logs 40 such as oak in open air draped with air pervious plastic material 16 of the same type as just described. The plastic material 16 is anchored to the ground by weights 42, such as cinder blocks, positioned upon the periphery of the plastic material. Typically the logs 40 measure approximately 20 feet in length and are stacked one on top of another so as to obtain a stack approximately 10 logs in height and 50 feet in width. The plastic material has a width of approximately 40 feet and a length of approximately 100 feet.

The air pervious plastic material 16, again preferably polypropylene or polyethylene, maintains the moisture within the logs and prevents their drying by restricting sunlight and wind. It has been found that the preferred material to air density of the material here is approximately 80%, although a density of between 70% and 90% may be effectively used. With this material density sunlight, wind and rain are restricted from the logs sufficiently to prevent checking and splitting while enough ventilation allowed to prevent fungi growth, staining and decay. A material density above 90% has been found to prevent adequate ventilation of the logs which results in the promotion of log staining fungi growth. Conversely a material density below 70% has been found inadequate in restricting the passage of sunlight, wind and rain so as to prevent the logs from becoming stained due to oxidation and to prevent the ends of the logs from becoming checked and split due to drying.

From the foregoing it is seen that a method for inhibiting the staining, checking and splitting of logs during open air storage is now provided. It should however be understood that the just described embodiments merely illustrate principles of the invention in its preferred forms. Many modifications, additions and deletions may, in addition to those expressly recited, be made thereto without departure from the spirit and scope of the invention as set forth in the following claims.

I claim:

1. A method of inhibiting the staining and checking of logs used in the manufacturer of lumber comprising the steps of:

(a) overlaying the logs with an air pervious plastic material having a material to air density of between 70% and 90%, and (b) positioning the material overlaid logs in open air.

2. The method of claim 1 wherein the logs are overlaid with plastic material having a material to air density of approximately 80% over the logs.

3. The method of claim 2 wherein the periphery of the plastic material is anchored to the ground.

4. The method of claim 1 wherein the logs are overlaid with plastic material comprised of polymeric material selected from the group consisting of polyethylene and polypropylene polymers.

5. The method of claim 1 wherein the logs are overlaid with a woven air pervious plastic material.

6. The method of claim 1 wherein steps (a) and (b) are performed in sequence.

* * * * *